US009314708B2

(12) United States Patent
Schramm

(10) Patent No.: US 9,314,708 B2
(45) Date of Patent: Apr. 19, 2016

(54) SPILL-PROOF COLORING CONTAINER

(76) Inventor: Michael R. Schramm, Perry, UT (US)

( * ) Notice: Subject to any disclaimer, the term of this patent is extended or adjusted under 35 U.S.C. 154(b) by 1941 days.

(21) Appl. No.: 11/618,921

(22) Filed: Jan. 1, 2007

(65) Prior Publication Data

US 2015/0314320 A1 Nov. 5, 2015

Related U.S. Application Data

(63) Continuation of application No. 10/092,878, filed on Mar. 6, 2002.

(51) Int. Cl.

| | |
|---|---|
| ***B44D 3/00*** | (2006.01) |
| ***A63H 33/28*** | (2006.01) |
| ***B65D 23/00*** | (2006.01) |

(52) U.S. Cl.

CPC *A63H 33/28* (2013.01); *B44D 3/00* (2013.01); *B65D 23/00* (2013.01)

(58) Field of Classification Search

CPC ..... B65D 23/00; B44D 3/00
USPC ..... 118/26, 13, 500; 220/719, 608, 734, 220/571, 571.1; 222/578, 584, 457
See application file for complete search history.

(56) References Cited

U.S. PATENT DOCUMENTS

| | | | | | |
|---|---|---|---|---|---|
| 1,245,013 | A | * | 10/1917 | Nowakowski | 4/283 |
| 1,254,714 | A | * | 1/1918 | McCombs | 401/129 |
| 1,305,428 | A | * | 6/1919 | Wilson | 4/258 |
| 2,063,559 | A | * | 12/1936 | Rogers | 4/258 |
| 2,119,308 | A | * | 5/1938 | Ashley | 222/579 |
| 2,810,491 | A | * | 10/1957 | Goldschmidt | 220/501 |
| 3,464,599 | A | * | 9/1969 | Meth | 222/589 |
| 3,781,164 | A | * | 12/1973 | McCaffery | 431/291 |
| 3,840,678 | A | * | 10/1974 | Price | 426/104 |
| 4,181,745 | A | * | 1/1980 | Growe et al. | 426/250 |
| 4,419,103 | A | * | 12/1983 | Balkan | 8/506 |
| 4,503,572 | A | * | 3/1985 | Dawson | 4/258 |
| 4,573,586 | A | * | 3/1986 | Helmer | 211/14 |
| 4,619,373 | A | | 10/1986 | Galer | |
| 4,693,205 | A | * | 9/1987 | Thill | 118/13 |
| 4,798,162 | A | * | 1/1989 | Nelson | 118/26 |
| 4,869,390 | A | * | 9/1989 | Kennedy | 220/709 |
| 4,921,713 | A | | 5/1990 | Fowler | |
| 4,967,687 | A | * | 11/1990 | McShane | 118/13 |
| 5,022,559 | A | * | 6/1991 | Condon | 222/109 |
| 5,074,239 | A | * | 12/1991 | Law | 118/429 |
| 5,088,950 | A | * | 2/1992 | LaFata | 446/19 |

(Continued)

FOREIGN PATENT DOCUMENTS

| | | |
|---|---|---|
| GB | 1428356 | 3/1976 |
| JP | 11-227388 | 8/1999 |

*Primary Examiner* — Fenn Mathew
(74) *Attorney, Agent, or Firm* — Michael R. Schramm

(57) ABSTRACT

The spill-proof coloring container is an invention that because of its unique geometry and design, will when oriented in any position prevent spillage of liquid contents when filled to predetermined amount. Because of the use of vacuum formed sheet in the construction of the container, the container pieces are compactly stackable and are of substantially low manufacturing cost. The container is principally intended for use by young children to facilitate painting pictures and dying objects such as Easter eggs without the mess otherwise associated with painting and dying. The invention is also intended to help avoid the mess associated with pouring paint or paint powder concentrates otherwise encountered when preparing a cup of paint for general purpose painting.

35 Claims, 4 Drawing Sheets

(56) References Cited

U.S. PATENT DOCUMENTS

| | | | | | |
|---|---|---|---|---|---|
| 5,105,975 | A | * | 4/1992 | Patterson | 220/709 |
| 5,140,711 | A | * | 8/1992 | Johnson | 4/258 |
| 5,143,294 | A | | 9/1992 | Lintvedt | |
| 5,246,046 | A | * | 9/1993 | Schramm | 141/98 |
| 5,495,876 | A | | 3/1996 | Schramm | |
| 5,565,229 | A | * | 10/1996 | Mandle | 426/250 |
| 5,678,684 | A | * | 10/1997 | Wright | 206/204 |
| 5,758,797 | A | * | 6/1998 | Martindale | 220/719 |
| D395,795 | S | * | 7/1998 | Pender et al. | D7/611 |
| 5,787,838 | A | * | 8/1998 | Abrams | 118/13 |
| 5,832,969 | A | | 11/1998 | Schramm | |
| RE36,131 | E | | 3/1999 | Schramm | |
| 5,881,670 | A | * | 3/1999 | Pelsor | 119/61.54 |
| 5,895,679 | A | * | 4/1999 | Pender et al. | 426/302 |
| 5,908,057 | A | | 6/1999 | Schramm | |
| 5,960,740 | A | * | 10/1999 | Pelsor | 119/61.54 |
| 6,008,172 | A | | 12/1999 | Broshi et al. | |
| 6,032,824 | A | * | 3/2000 | Barrow | 220/621 |
| 6,110,514 | A | * | 8/2000 | Powers | 426/300 |
| 6,142,101 | A | * | 11/2000 | Pelsor | 119/61.54 |
| 6,168,021 | B1 | | 1/2001 | Herbruck | |
| 6,386,138 | B1 | * | 5/2002 | Schramm | 118/26 |
| 6,446,827 | B1 | * | 9/2002 | Akins | 220/570 |
| 6,447,356 | B1 | * | 9/2002 | Lapointe | 446/16 |
| 6,530,815 | B1 | * | 3/2003 | Bro et al. | 446/15 |
| 6,971,530 | B2 | * | 12/2005 | Darr | 215/43 |
| RE39,443 | E | | 12/2006 | Schramm | |
| 2003/0015539 | A1 | * | 1/2003 | Hayes et al. | 220/608 |
| 2003/0116575 | A1 | * | 6/2003 | Ellingson et al. | 220/719 |
| 2006/0076101 | A1 | * | 4/2006 | Krivich | 156/86 |
| 2007/0210594 | A1 | * | 9/2007 | Wong | 294/14 |

* cited by examiner

SPILL-PROOF COLORING CONTAINER

This application is a continuation of co-pending application Ser. No. 10/092,878 filed Mar. 6, 2002. The benefit of the filing date of this earlier filed application but no other earlier filed application is claimed under 35 U.S.C. §120.

BACKGROUND OF THE INVENTION

The present invention relates to spill-resistant coloring containers. The invention has particular application for use by children in coloring and more especially by children coloring chicken eggs of the type associated with Easter celebrations.

It is well known that coloring containers have existed for some time and are commercially available in a variety of embodiments. It is noted that when using coloring containers, the user typically requires a plurality of containers to access a plurality of individual paint colors. Also when dying Easter eggs, the user typically requires a plurality of containers to access a plurality of individual dye colors. Prior to applicant's co-pending application, and other applications by applicant which have matured into U.S. patents, these containers have been of a type and geometry which provided little or no resistance to spillage of liquid contents of the container. Furthermore, most of these containers were not easily stackable for compact packaging and typically were not of sufficiently low cost of manufacture to consider the container disposable. It is noted that disposable drink containers such as waxed paper cups with thermoformed plastic lids have existed for some time and are widely available. While such lids typically have an opening to accept a drinking straw, and such opening usually includes a short flange, these flanges are typically not know to extend from the opening of the lid by more than 0.25 inches and thus provide virtually no spill resistance.

SUMMARY OF THE INVENTION

The present invention relates to an improved spill-resistant coloring container. The container can be used in combination with a coloring agent such as a liquid dye or a dye tablet or a paint pill such as tempura paint contained within a water soluble gelatin capsule, a chicken egg, and a utensil such as a wire egg dipper, a spoon, a brush, a pair of tongs, or a straw. In practice, the user places liquid dye or a coloring concentrate and water and a colorable object such as an egg within the container. The user may then use a select utensil to agitate the object and the coloring agent within the container or the user may simply allow the object to dwell unagitated for a period of time within the coloring agent. After a desired amount of time has passed, the user, preferably with the aid of a utensil, withdraws the object from the container. Alternatively, the container can be used without having a colorable object within the container such as for painting objects or pictures that reside outside of the container. In practice, the user places a coloring agent such as water and a water soluble paint capsule, water and a water soluble dye tablet, or a liquid dye or the like within the container. The user then uses the paintbrush to withdraw desired amounts of coloring agent from the container to paint a work piece. Furthermore, the container may be used as a container for edible liquids wherein the users withdraws the edible liquids with a select utensil such as a spoon or a straw. It is intended that the container may provide a dual function of both dying Easter eggs and subsequent general painting use. In the case where the coloring kit is used only for general purpose, it is noted that the container cup geometry could be simplified to take on the shape of a standard cylindrical shaped cup.

The preferred embodiment of the present invention comprises a kit that includes a container having a cup portion and a lid portion, an egg workpiece, an egg dipper utensil, a paint brush utensil, and a dye concentrate tablet. The cup portion and the lid portion each include an engagement ridge such that the lid portion is removably and snappingly attachable to the cup portion. The assembly of the lid and cup together define the spill-proof coloring container. The lid further defines an opening connected to a funnel. The funnel extends into the container and provides communication between the inside of the container and the outside of the container. The funnel facilitates the access of both liquid contents of the container with a utensil as well as the ready insertion and withdrawal of a work piece to be colored such as an egg. The cup includes a well portion which provides for pooling of the liquid contents of the container and provides improved efficiency of the container with a minimal amount of liquid contents. The cup further includes liquid flow channels which allow for the flow of liquid such as from the lower portion of the container to the upper portion of the container between the walls of the container and the funnel while prohibiting the egg from becoming entrapped between the walls of the container and the funnel. In usage, when a predetermined amount of liquid, such as water with the dye tablet dissolved in the water, is placed within the assembled container, the assembled container can be oriented in any position without spilling it's liquid contents.

Both the lid and the cup are comprised of vacuum formed, substantially uniformly thick plastic sheet. The sheet is preferably any thickness of no greater than 0.05 inches thick such as 0.05, 0.045, 0.04, 0.035, 0.03, 0.025, 0.020, 0.01, 0.005 inches thick and is clear or transparent. The funnel is preferably of a length of between 0.25 inches and the length of the container and can specifically include for instance lengths of 0.25, 0.30 0.35, 0.40, 0.45, 0.50, 0.60, 0.75, 1.0, 1.25, 1.5, 1.75, 2.0, 2.25, 3.0, 3.5, 3.75, 4.0, and 5.0 inches. The cup and lid may be alternatively injection molded. Both the lid and the cup are shaped such that multiple lids can be nested or stacked within one another and multiple cups can be nested or stacked within one another.

Accordingly, in the preferred embodiment, it is an object of the present invention to provide a spill-resistant container wherein the members making up the container are stackable to provide for compact packaging of a plurality of container cups and lids within a single package. It is a further object to provide a spill-resistant container wherein the funnel of the container allows for ready ingress and egress of a work piece to be colored such as an egg. It is a further object to provide a spill-resistant container wherein the manufacturing cost of the container is sufficiently low such that the container can be considered disposable. It is a further object to provide a spill-resistant container wherein the members which make up the container define vacuum formed plastic sheet. It is a further object to provide a spill-resistant coloring kit that not only resists liquid spills, but provides convenience for the user by avoiding the need to pour a liquid paint or a paint powder concentrate or the like into the container in order to use the container in coloring.

DESCRIPTION OF DRAWINGS

The objects and many attendant advantages of this invention will be readily appreciated and become readily apparent as the same becomes better understood by reference to the following detailed description, when considered in conjunction with the accompanying drawings and in which like reference numerals designate like parts throughout the figures thereof and wherein.

DETAILED DESCRIPTION OF THE INVENTION

In order to facilitate the understanding of the present invention in reviewing the drawings accompanying the specification, a feature list is provided below. It is noted that like features are like numbered throughout all of the figures.

Feature Table

| # | Feature |
|---|---|
| 10 | Container assembly |
| 20 | Cup |
| 22 | Cup engagement ridge |
| 24 | Cup well |
| 26 | Cup liquid flow channel - typical |
| 30 | Lid |
| 31 | Lid tab handle |
| 32 | Lid engagement ridge |
| 34 | Lid funnel |
| 36 | Funnel upper opening |
| 38 | Funnel lower opening |
| 40 | Liquid coloring agent |
| 50 | Egg workpiece |
| 60 | Brush utensil |
| 70 | Dye tablet |

Figure 1:
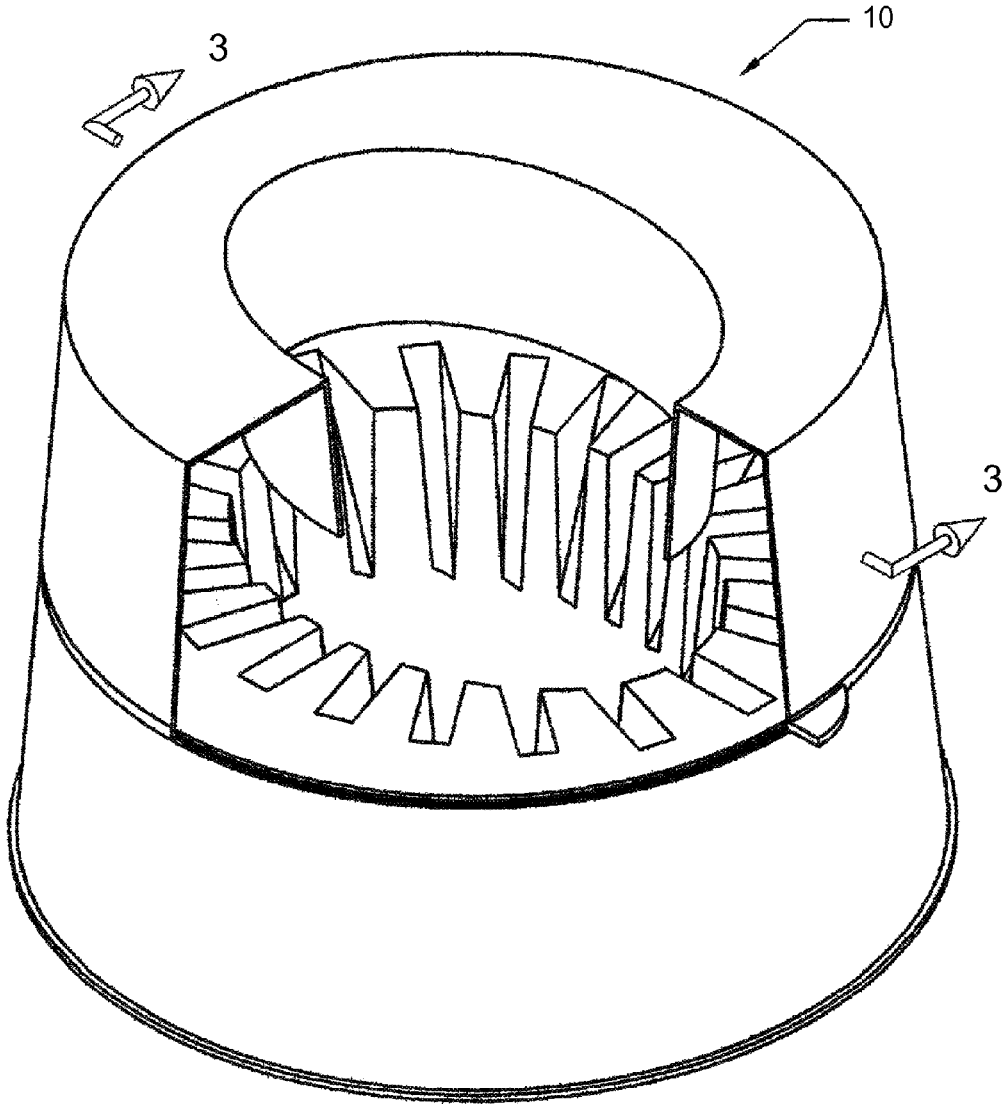
FIG. 1 is an isometric assembly view of the container. The front right portion of the container lid is shown cut away. Due to the thickness of the container lid walls being substantially thin and for clarity, cross-hatching is not shown.
Figure 2:
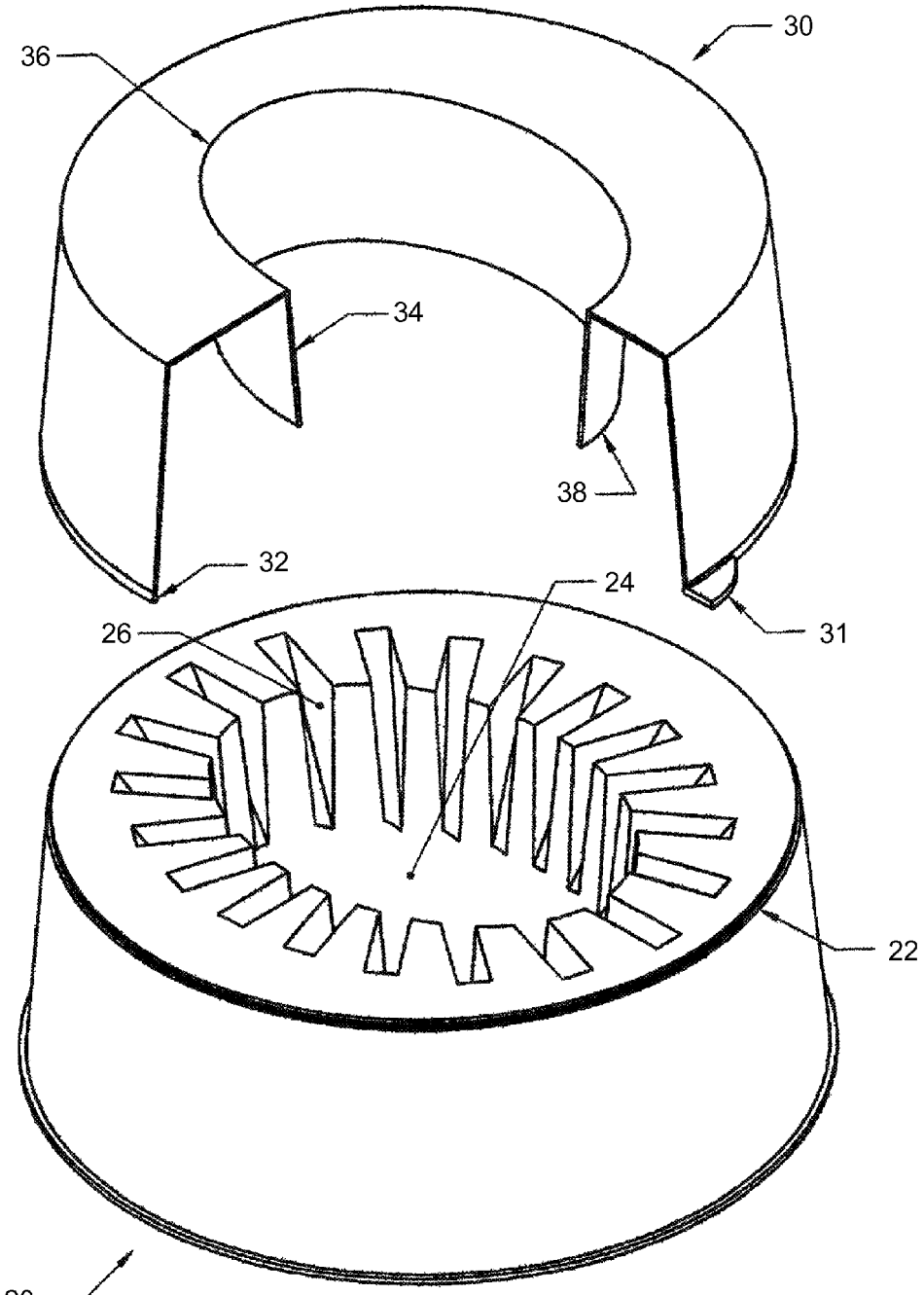
FIG. 2 is an exploded isometric view of the various parts that make up the container and illustrates their relationship to each other. The portion shown cut away is identical to that shown in FIG. 1. Due to the thickness of the container lid walls being substantially thin and for clarity, cross-hatching is not shown.

Referring now to the drawings and particularly to FIGS. 1 and 2, the invention is a container 10 that comprises a cup 20 and a lid 30. The cup 20 includes an engagement ridge 22, a well 24, a base flange 26, and a plurality of flow channels 26. The lid 30 includes a tab handle 31, an engagement ridge 32, a funnel 34, a funnel upper opening 36, and a funnel lower opening 38. When cup 20 and lid 30 are snappingly engaged, they form a substantially liquid tight seal. The invention also includes an egg workpiece 50, a brush utensil 60, and a dye tablet 70 removably contained within the container.

Figure 3:
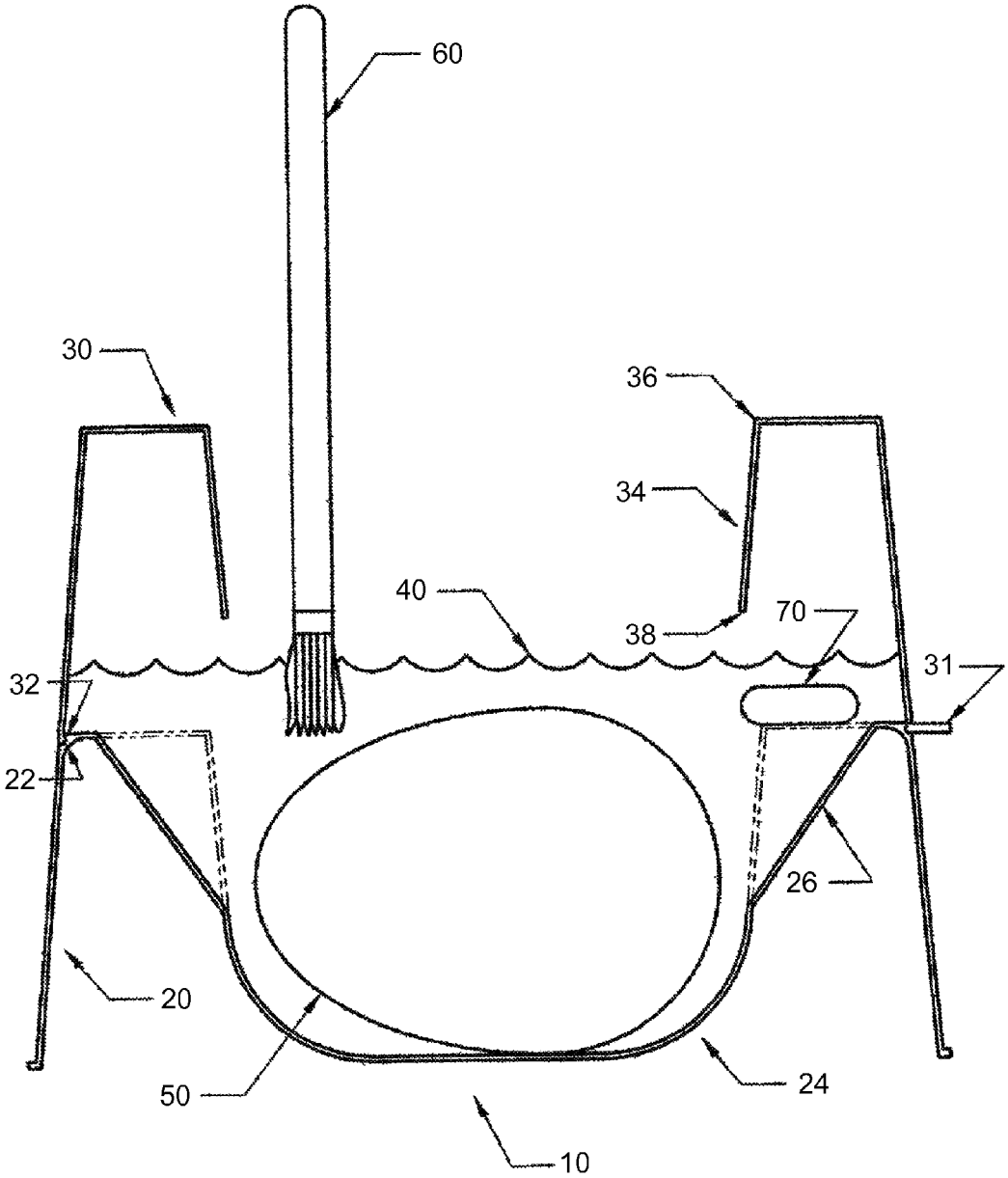
FIG. 3 is an orthographic section view of the container taken at the location indicated by the arrows shown in FIG. 1. Due to the thickness of the container walls being substantially thin and for clarity, cross-hatching is not shown. An egg, liquid dye, and a partially dissolved dye tablet are shown retained in the bottom of the cup well and a brush is shown removably positioned within the container. The portions of the well wall that do not intersect the section cut are shown in phantom lines.
Figure 5:
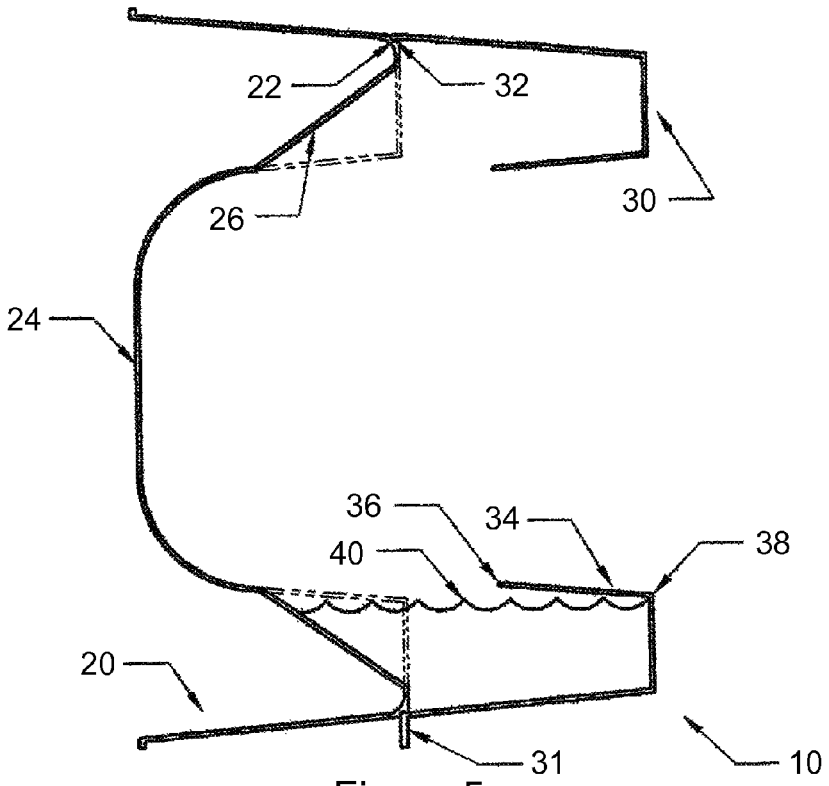
FIG. 5 is a sideways orientation of FIG. 3. Due to the thickness of the container walls being substantially thin and for clarity, cross-hatching is not shown. The liquid dye is shown retained in the side of the container. The egg, the brush, and the dye tablet are not shown in the container. The portions of the well wall that do not intersect the section cut are shown in phantom lines.
Figure 4:
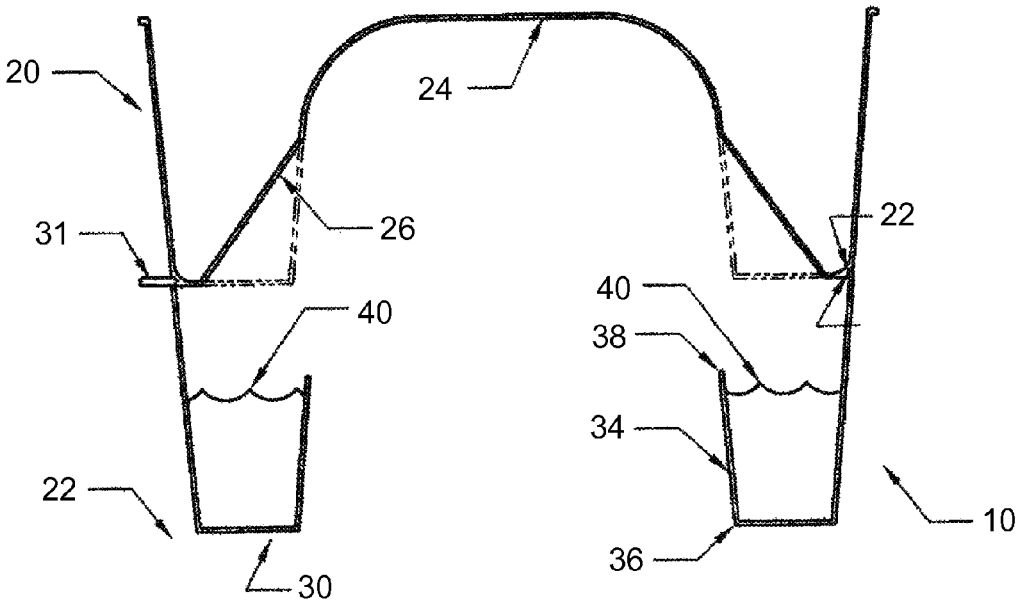
FIG. 4 is an inverted orientation of FIG. 3. Due to the thickness of the container walls being substantially thin and for clarity, cross-hatching is not shown. The liquid dye is shown retained in the top of the container. The egg, the brush, and the dye tablet are not shown in the container. The portions of the well wall that do not intersect the section cut are shown in phantom lines.

FIGS. 3-5 illustrate the unique advantages of spill resistance of the subject invention in spite of a colorable work piece such as egg 50 being removably placed within container 10 when container 10 is filled with fluid to a predetermined amount and oriented in any orientation. As is apparent from FIG. 3, when container 10 is in the upright position liquid will always be in the well 24 portion of cup 20. When container 10 is in the upside down position as in FIG. 4, the liquid will occupy the space immediately around funnel 34 but will not be able to enter funnel 34 for discharge through funnel opening 38. When container 10 is in a sideways position as in FIG. 5, the liquid level will always be between the side of the funnel 34 and the lower side of the cup 20 and lid 30. Furthermore, when the container 10 is oriented in any of an infinite variations of the above described positions, it will behave in a like manner and prevent the spillage of the liquid contents.

Lastly, the preferred method of fabrication is vacuum form molding for high volume low cost production. The preferred material is clear or transparent sheet of PETE plastic of no more than 0.05 inches thick and preferably in the range of 0.010 to 0.015 inches thick.

While there is shown and described herein certain specific structure embodying the invention, it will be manifest to those skilled in the art that various modifications and rearrangements of the parts may be made without departing from the spirit and scope of the underlying inventive concept. The subject invention is not limited to the particular forms herein shown and described except insofar as indicated by the scope of the appended claims.

I claim:

1. A container for use in coloring eggs without spilling egg dye, said container having an inner cavity, an exterior, at least one non-gaseous fluid flow groove formed in a wall of said container, an opening in a wall of said container providing communication between said inner cavity and the exterior of said container, and a funnel connected to said opening.

2. The container of claim 1 wherein said container defines an upper container portion and a lower container portion, and wherein said opening is located in an upper container portion wall, and wherein said funnel extends inward from said opening towards said inner cavity, and wherein said non-gaseous fluid flow groove defines a plurality of non-gaseous fluid flow grooves spaced about a lower container portion wall.

3. The container of claim 2 wherein said container is adapted such that when a non-gaseous fluid and an object are contained within said container and said container is rotated, said non-gaseous fluid flows through said non-gaseous fluid flow grooves into a space within said container between said funnel and an upper container portion wall, but said object is prevented from moving into said space within said container between said funnel and an upper container portion wall.

4. The container of claim 3 wherein said container resists the spillage of non-gaseous fluid contents of said container when said container contains non-gaseous fluid contents and is oriented in any orientation.

5. The container of claim 4 wherein said funnel and said opening are adapted such that said object may pass through said funnel and said opening to be removed from said container.

6. The container of claim 5 wherein at least a portion of a colorable workpiece is removably contained within said container, and wherein said colorable workpiece defines at least one colorable workpiece of the following group of colorable workpieces consisting of a substantially egg shaped work piece, an edible work piece, a substantially egg shaped edible work piece, and an egg, and wherein at least a portion of a utensil is removably contained within said container, and wherein said utensil defines at least one utensil of the following group of utensils consisting of a brush, a spoon, a wire egg dipper, a pair of tongs, and a straw, and wherein said container contains at least one colorant of the following group of colorants consisting of a colorant tablet, a predetermined quantity of powdered colorant, a discrete unit of colorant concentrate, and a colorant pill defining a colorant powder concentrate enclosed within a liquid soluble container.

7. The container of claim 1 wherein said container removably contains at least a portion of a colorable workpiece, a utensil, and a colorant.

8. The container of claim 7 wherein said colorable workpiece defines at least one colorable workpiece of the following group of colorable workpieces consisting of a substantially egg shaped work piece, an edible work piece, a substantially egg shaped edible work piece, and an egg, and wherein said utensil defines at least one utensil of the following group of utensils consisting of a brush, a spoon, a wire egg dipper, a pair of tongs, and a straw, and wherein said colorant defines at least one colorant of the following group of colorants consisting of a colorant tablet, a predetermined quantity of powdered colorant, a discrete unit of colorant concentrate, and a colorant pill defining a colorant powder concentrate enclosed within a liquid soluble container.

9. A container for use in coloring eggs without spilling egg dye, said container having an inner cavity, an exterior, at least one non-gaseous fluid flow groove formed in a wall of said container, an opening in a wall of said container providing communication between said inner cavity and the exterior of said container, and wherein said container resists the spillage of non-gaseous fluid contents of said container when said container contains non-gaseous fluid contents and is oriented in any orientation.

10. The container of claim 9 wherein said container includes a funnel connected to said opening.

11. The container of claim 10 wherein said container defines an upper container portion and a lower container portion, and wherein said opening is located in an upper container portion wall, and wherein said funnel extends inward from said opening towards said inner cavity, and wherein said non-gaseous fluid flow groove defines a plurality of non-gaseous fluid flow grooves spaced about a lower container portion wall.

12. The container of claim 10 wherein said container defines an upper container portion and a lower container portion, and wherein said opening is located in an upper container portion wall, and wherein said funnel extends inward from said opening towards said inner cavity, and wherein said non-gaseous fluid flow groove defines a plurality of non-gaseous fluid flow grooves spaced about a lower container portion wall.

13. The container of claim 12 wherein said funnel and said opening are adapted such that said object may pass through said funnel and said opening to be removed from said container.

14. The container of claim 13 wherein at least a portion of a colorable workpiece is removably contained within said container, and wherein said colorable workpiece defines at least one colorable workpiece of the following group of colorable workpieces consisting of a substantially egg shaped work piece, an edible work piece, a substantially egg shaped edible work piece, and an egg, and wherein at least a portion of a utensil is removably contained within said container, and wherein said utensil defines at least one utensil of the following group of utensils consisting of a brush, a spoon, a wire egg dipper, a pair of tongs, and a straw, and wherein said container contains at least one colorant of the following group of colorants consisting of a colorant tablet, a predetermined quantity of powdered colorant, a discrete unit of colorant concentrate, and a colorant pill defining a colorant powder concentrate enclosed within a liquid soluble container.

15. The container of claim 9 wherein said container removably contains at least a portion of a colorable workpiece, a utensil, and a colorant.

16. The container of claim 15 wherein said colorable workpiece defines at least one colorable workpiece of the following group of colorable workpieces consisting of a substantially egg shaped work piece, an edible work piece, a substantially egg shaped edible work piece, and an egg, and wherein said utensil defines at least one utensil of the following group of utensils consisting of a brush, a spoon, a wire egg dipper, a pair of tongs, and a straw, and wherein said colorant defines at least one colorant of the following group of colorants consisting of a colorant tablet, a predetermined quantity of powdered colorant, a discrete unit of colorant concentrate, and a colorant pill defining a colorant powder concentrate enclosed within a liquid soluble container.

17. A container for use in coloring eggs without spilling egg dye, said container having an inner cavity, an exterior, at least one non-gaseous fluid flow groove formed in a wall of said container, and an opening in a wall of said container providing communication between said inner cavity and the exterior of said container, and wherein at least a portion of an object is removably contained within said container.

18. The container of claim 17 wherein said container includes a funnel connected to said opening, and wherein said container resists the spillage of non-gaseous fluid contents of said container when said container contains non-gaseous fluid contents and is oriented in any orientation.

19. The container of claim 18 wherein said container defines an upper container portion and a lower container portion, and wherein said opening is located in an upper container portion wall, and wherein said funnel extends inward from said opening towards said inner cavity, and wherein said non-gaseous fluid flow groove defines a plurality of non-gaseous fluid flow grooves spaced about a lower container portion wall.

20. The container of claim 19 wherein said container is adapted such that when a non-gaseous fluid and an object are contained within said container and said container is rotated, said non-gaseous fluid flows through said non-gaseous fluid flow grooves into a space within said container between said funnel and an upper container portion wall, but said object is prevented from moving into said space within said container between said funnel and an upper container portion wall.

21. The container of claim 20 wherein said funnel and said opening are adapted such that said object may pass through said funnel and said opening to be removed from said container.

22. The container of claim 21 wherein at least a portion of a colorable workpiece is removably contained within said container, and wherein said colorable workpiece defines at least one colorable workpiece of the following group of colorable workpieces consisting of a substantially egg shaped work piece, an edible work piece, a substantially egg shaped edible work piece, and an egg, and wherein at least a portion of a utensil is removably contained within said container, and wherein said utensil defines at least one utensil of the following group of utensils consisting of a brush, a spoon, a wire egg dipper, a pair of tongs, and a straw, and wherein said container contains at least one colorant of the following group of colorants consisting of a colorant tablet, a predetermined quantity of powdered colorant, a discrete unit of colorant concentrate, and a colorant pill defining a colorant powder concentrate enclosed within a liquid soluble container.

23. The container of claim 17 wherein said container removably contains at least a portion of a colorable workpiece, a utensil, and a colorant.

24. The container of claim 23 wherein said colorable workpiece defines at least one colorable workpiece of the following group of colorable workpieces consisting of a substantially egg shaped work piece, an edible work piece, a substantially egg shaped edible work piece, and an egg, and wherein said utensil defines at least one utensil of the following group of utensils consisting of a brush, a spoon, a wire egg dipper, a pair of tongs, and a straw, and wherein said colorant defines at least one colorant of the following group of colorants consisting of a colorant tablet, a predetermined quantity of powdered colorant, a discrete unit of colorant concentrate, and a colorant pill defining a colorant powder concentrate enclosed within a liquid soluble container.

25. A container for use in coloring eggs without spilling egg dye, said container having an inner cavity, an exterior, at least one non-gaseous fluid flow groove formed in a wall of said container, an opening in a wall of said container providing communication between said inner cavity and the exterior of said container, and a funnel connected to said opening, and wherein at least a portion of an object is removably contained within said container, and wherein said container resists the spillage of non-gaseous fluid contents of said container when said container contains non-gaseous fluid contents and is oriented in any orientation.

26. The container of claim 25 wherein said container defines an upper container portion and a lower container portion, and wherein said opening is located in an upper container portion wall, and wherein said funnel extends inward from said opening towards said inner cavity, and wherein said non-gaseous fluid flow groove defines a plurality of non-gaseous fluid flow grooves spaced about a lower container portion wall, and wherein said container is adapted such that when a non-gaseous fluid and an object are contained within said container and said container is rotated, said non-gaseous fluid flows through said non-gaseous fluid flow grooves into a space within said container between said funnel and an upper container portion wall, but said object is prevented from moving into said space within said container between said funnel and an upper container portion wall.

27. A container for use in coloring eggs without spilling egg dye, said container having an inner cavity, an exterior, and an opening in a wall of said container providing communication between said inner cavity and the exterior of said container, wherein said container contains non-gaseous fluid contents and a substantially solid-form object substantially immersed in said non-gaseous fluid contents, and wherein said container resists the spillage of said non-gaseous fluid contents of said container when said container contains said non-gaseous fluid contents and said substantially solid-form object substantially immersed in said non-gaseous fluid contents and is oriented in any orientation.

28. The container of claim 27 wherein said container includes at least one of at least one non-gaseous fluid flow channel formed in a wall of said container and a funnel connected to said opening in a wall of said container.

29. The container of claim 27 wherein said container removably contains at least one of a colorant and at least a portion of a utensil.

30. The container of claim 27 wherein said opening is adapted such that said object may pass through said opening to be removed from said container, and wherein said non-gaseous fluid contents define a liquid.

31. The container of claim 27 wherein said container includes at least one non-gaseous fluid flow channel formed in a wall of said container and a funnel connected to said opening in a wall of said container, and wherein said container removably contains a colorant and at least a portion of a utensil, and wherein said opening is adapted such that said object may pass through said opening to be removed from said container, and wherein said non-gaseous fluid contents defines a liquid.

32. The container of claim 31 wherein said object defines at least one of a substantially egg shaped object, an edible object, a substantially egg shaped edible object, and an egg, and wherein said utensil defines at least one of a brush, a spoon, a wire egg dipper, a pair of tongs, and a straw, and wherein said colorant defines at least one of a colorant tablet, a predetermined quantity of powdered colorant, a discrete unit of colorant concentrate, and a colorant pill defining a colorant powder concentrate enclosed within a liquid soluble container, and wherein said liquid defines water.

33. A container for use in coloring eggs without spilling egg dye, said container having an inner cavity, an exterior, an opening in a wall of said container providing communication between said inner cavity and the exterior of said container, and at least one of a funnel connected to said opening and extending into said inner cavity and at least one non-gaseous fluid flow groove formed in a wall of said container, and wherein said container contains a substantially solid-form object substantially immersed in a non-gaseous fluid.

34. The container of claim 33 wherein said container resists the spillage of said non-gaseous fluid contents of said container when said container contains non-gaseous fluid contents and is oriented in any orientation.

35. A container for use in coloring eggs without spilling egg dye, said container having an inner cavity, an exterior, at least one non-gaseous fluid flow groove formed in a wall of said container, an opening in a wall of said container providing communication between said inner cavity and the exterior of said container, and a funnel connected to said opening, and wherein said container is adapted such that when liquid and an object are contained within said container and said container is rotated, said liquid flows through said at least one non-gaseous fluid flow groove into a space within said container between said funnel and a container upper portion wall, and such that said object is prevented from moving into said space within said container between said funnel and an upper container portion wall.

* * * * *